United States Patent [19]

Hamada

[11] 4,364,590

[45] Dec. 21, 1982

[54] AUTOMOBILE DOOR LOCKING APPARATUS WITH CANCELLATION MECHANISMS

[75] Inventor: Yoshikazu Hamada, Tokyo, Japan

[73] Assignee: Mitsui Kinzoku Kogyo Kabushiki Kaisha, Tokyo, Japan

[21] Appl. No.: 140,089

[22] Filed: Apr. 14, 1980

[30] Foreign Application Priority Data

Jul. 9, 1979 [JP] Japan ..... 54-86668

[51] Int. Cl.[3] ..... E05C 3/00

[52] U.S. Cl. ..... 292/336.3; 292/216; 292/280

[58] Field of Search ..... 292/216, 280, DIG. 23, 292/DIG. 26, DIG. 27, 198, 336.3

[56] References Cited

U.S. PATENT DOCUMENTS

| | | | |
|---|---|---|---|
| 3,666,308 | 5/1972 | Bonnaud | 292/336.3 |
| 3,809,416 | 5/1974 | Kazoaka | 292/216 |
| 3,823,966 | 7/1974 | Torii | 292/216 |
| 3,844,596 | 10/1974 | Torii et al. | 292/280 X |
| 3,899,202 | 8/1975 | Pickles | 292/216 |
| 3,999,791 | 12/1976 | Torii | 292/280 X |
| 4,005,887 | 1/1977 | Itakura | 292/216 |
| 4,196,925 | 4/1980 | Torii | 292/216 |

*Primary Examiner*—Roy D. Frazier
*Assistant Examiner*—Peter A. Aschenbrenner
*Attorney, Agent, or Firm*—Browdy and Neimark

[57] ABSTRACT

Automobile door locking apparatus with cancellation mechanisms, the mechanisms consisting of an open lever, a locking lever, a lever connecting the above two levers, and a cancellation lever which are all operatively fitted to a back surface of base body of the door locking apparatus. Said back surface has a projection for a door striker. The above levers are located aside said projection and substantially within the level of said projection so as to provide a window glass channel with a wider front width.

3 Claims, 6 Drawing Figures

AUTOMOBILE DOOR LOCKING APPARATUS WITH CANCELLATION MECHANISMS

Figure 1:
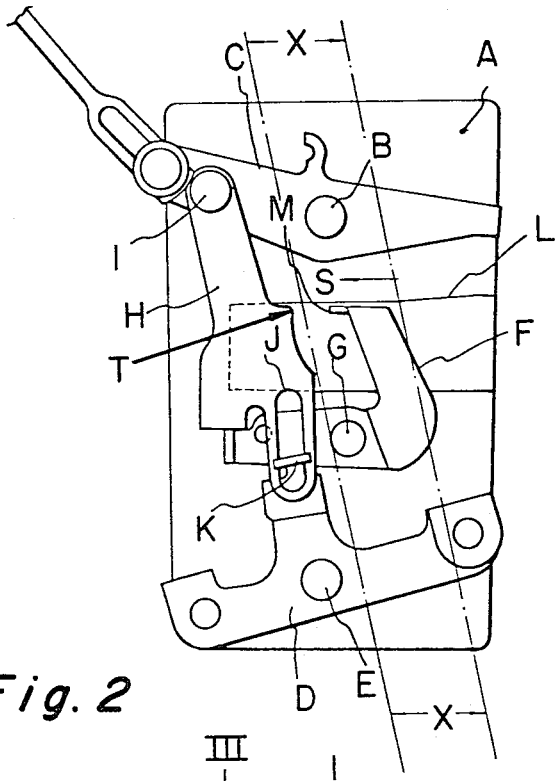

This invention relates to an automobile door locking apparatus, and more particularly an automobile door locking apparatus of the type which is incorporated with cancellation mechanisms.

An automobile door is often closed with its locking knob having been unintentionally pressed, resulting in having the door locked possibly with the key inside the vehicle. In order to prevent such mistakes, cancellation mechanisms have been developed and incorporated into the automobile door locking apparatus. When an automobile door is closed simply by having pressed its locking knob, the locking of door is automatically released on account of the cancellation mechanisms. This invention is to make an automobile locking apparatus of the above type more compact and more reasonable for the aforementioned purpose.

This invention shall be explained more in detail hereinunder, compared to conventional ones and with reference to the accompanying drawing.

Figure 2:
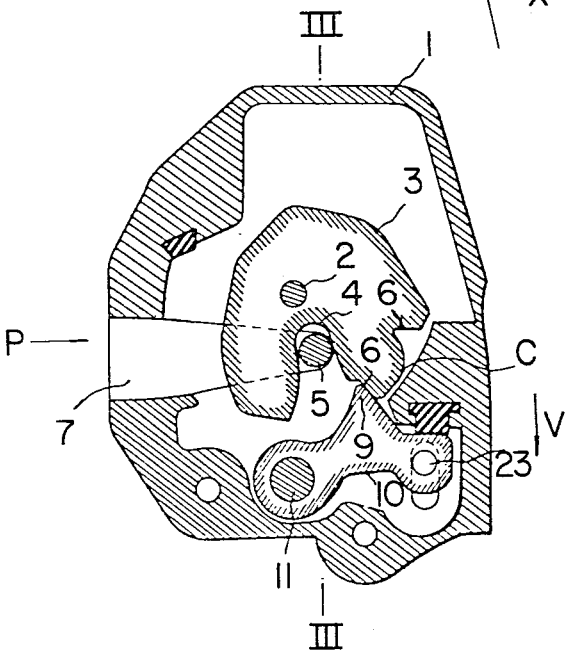
Figure 3:
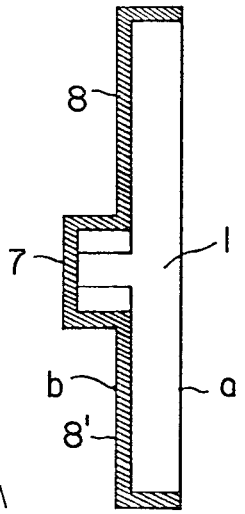
Figure 4:
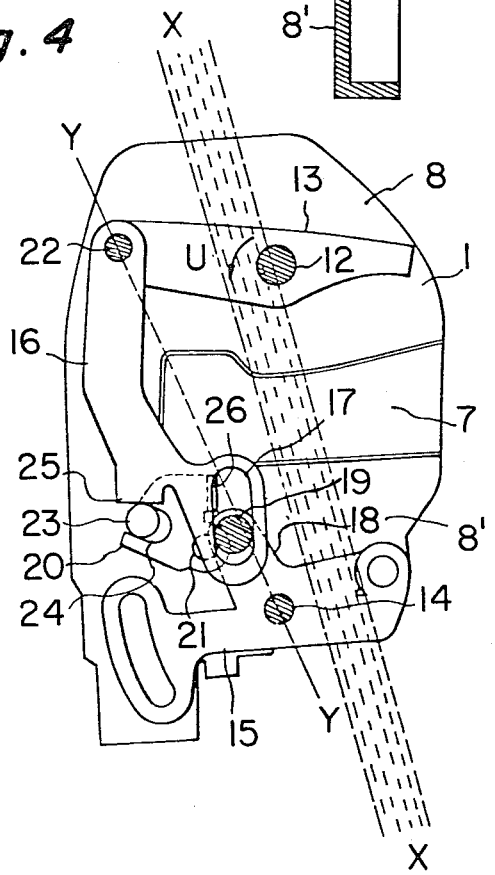
Figure 5:
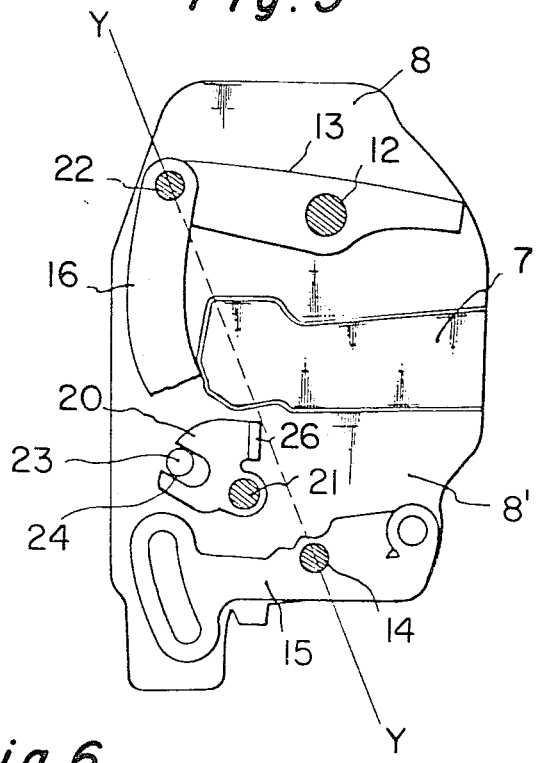
Figure 6:
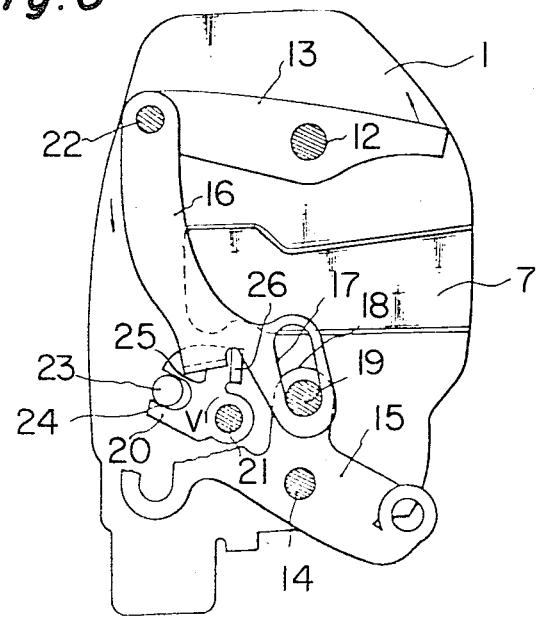

In the drawing;

FIG. 1 shows one of conventional cancellation mechanisms of the above-mentioned kind in its back view, FIG. 2 is a vertical front sectional view of this invention apparatus, FIG. 3 is a sectional view of a base body along the line III—III in FIG. 2, FIG. 4 is a back view of the present invention apparatus, FIG. 5 is a partially cut view of FIG. 4, and FIG. 6 is a view similar to FIG. 5, in which the mechanisms are at the locked position.

At first, conventional mechanisms of the kind are explained with reference to FIG. 1. A is a body, on the back surface and upper central part of which a shaft B is provided. To said shaft B, an open lever C is pivotally fixed. A locking lever D is pivotally fitted to the base body by a shaft E, whereby said lever D occupies a lower part of the base body in comparison to the open lever C which occupies the upper part of the base body as described above. A cancellation lever F is also pivotally fixed to the base body so as to extend over and occupy a full space between the open lever and the locking lever. In FIG. 1, G indicates a pivot shaft of the cancellation lever F, and H a connecting lever, upper end of which is pivotally connected to the open lever C by a pin I and lower end of which is formed with an elongated slot J which in turn receives therein a projection K of locking lever D so as to establish the engagement of said lever with the connecting lever H. Conventional cancellation mechanisms as illustrated in FIG. 1 have numerous drawbacks.

A major drawback is that the inadequate location of the cancellation lever F presents difficulties in fitting a channel of window glass to a door, since the channel generally extends in line with a zone as illustrated in FIG. 1 by X—X. As said zone X—X lies over a projection L in which the striker engages and which swells towards said zone, the front width of the window glass channel has to be narrowed as much as the swell of said projection . If a mechanical part is placed above the projection L, it inevitably narrows further the front width of the glass channel. The cancellation lever F in FIG. 1 is the very one which is within the zone X—X and which further narrows.

A second drawback is that the mechanisms are heavy to operate. Under the structures illustrated in FIG. 1, when the door is closed, an abutment M rotates in the direction S, whereby it presses the connecting lever H to effect the cancellation of locking. To wit, the said abutment M presses the connecting lever H at its portion T, which is a mid point of the entire length of said lever H. If said lever H were actuated at a portion other than the portion T and closer to the projection K more remote from the pin I, it could be operated lightly. This is not so in case of structures illustrated in FIG. 1. While conventional cancellation mechanisms have other drawbacks, the aforementioned ones are those which the present invention intends to solve.

With reference to the drawing, the automobile locking apparatus of the present invention is now explained hereinunder.

To a base body 1 of the locking apparatus which is fitted to an automobile door, there is provided at its central front surface a latch 3 which is pivoted about a shaft 2, as shown in FIG. 2. Numeral 4 indicates a slot opening which is formed on the circumferential surface of the latch 3. A striker 5 is fixed to the automobile body part and is engageable with the shoulder 4, and a shoulder 6 is formed on a circumferential part of the latch 3. When said base body 1 is seen in the direction P in FIG. 1, it has at its back surface b, as best shown in FIG. 3, a projection 7 which is engageable with the striker 5, and it is otherwise flat. This flat back surface constitutes low plates 8, 8' for fixing devices. On the front surface a of the base body, a ratchet 10 having a pawl 9 which prevents reverse rotation of the latch 3 by its engagement with the shoulder 6 of said latch 3, is pivotally fitted to a shaft 11. As shown in FIG. 4, on the back surface b of the base body and on the central part of plate 8, there is pivotally fitted a laterally extending open lever 13. On the plate 8' at its central part a locking lever 15 is pivotally fitted by a shaft 14. The said shafts 12, 14 are located substantially at the mid point of the levers 13, 15 as in the case of conventional apparatus of the kind, and the open lever 13 and the locking lever 15 lie substantially in parallel with the plates 8, 8' and their ends are swingable, see-saw fashion. As shown in FIG. 4, a connecting lever 16 is pivotally fitted at it upper end to the left end of the open lever 13 by a pin 22. Said lever 16 extends downwardly at the left side on the back surface b so as to avoid, as explained above and with reference to FIG. 1, the travelling channel X—X of window glass, and it has a slot 17 which extends vertically. In said slot 17, there is engaged a pin 19 which is formed on the forward end of an engagement piece 18 extending from the locking lever upwardly at its part adjacent to the shaft 14. A cancellation lever 20 which corresponds to the cancellation lever F in FIG. 1, is not fitted to the shaft 11 of the ratchet 10, contrary to the case shown in FIG. 1, but is fitted to a shaft 21 other than the said shaft 11. Said shaft 21 is preferably located at the left side of the Y—Y (FIG. 4) which connects the connecting pin 22 of the connecting lever and open lever 13 and the shaft 14 of the locking lever 15, and in addition, it is located adjacent to the shaft 14. With reference to FIG. 2, to the right end or free end of the ratchet 10, there is fitted the base portion of a connecting pin 23, while the other end portion of said connecting pin 23 penetrates through the base body 1, projects above the back surface 8, and engages with a recess 24 of the cancellation lever 20. Hence, when the cancellation lever 20 rotates counter-clockwise in FIG. 4, the ratchet 10 is rotated clockwise in FIG. 2. When the locking lever 15 is at the unlocked position (FIG. 4), a bent portion 25 which is provided on the connecting lever adjacent to its slot 17, abuts downwardly upon the connecting pin 23. Therefore, when the open lever 13 is rotated counter-clockwise in FIG. 4, the bent portion 25 moves the connecting pin downwardly, resulting in having the ratchet 10 rotated clockwise in FIG. 2 and in releasing the pawl 9 from the shoulder 6 for opening the automobile door. However, when the locking lever 15 is brought to its locking position (FIG. 6), the pin 19 works to press the slot 17 of the connecting lever 16 to the right side, whereby the bent portion 25 of the connecting lever disengages from the uppermost portion of the connecting pin 23. In this instance, the counter-clockwise rotation of the open lever 13 does not produce the engagement of the bent portion 25 with the connecting pin, whereby said pin is kept idle and does not allow the door open. As shown in FIG. 5, an abutment 26 which is formed at the right side portion of the cancellation lever 20 contacts slightly with the bent portion 25, when the locking lever 15 is at the locking position.

It shall be noted again that the cancellation lever 20 and its movement are substantially in the location apart from the zone X—X, see FIG. 4.

In the present invention having the above construction, when the locking lever 15 is rotated to the unlocked position as shown in FIG. 4 and the open lever 13 is rotated in the direction U by the opening operation of door, the connecting lever 16 is moved downwardly whereby the connecting pin 23 is also moved downwardly by the undersurface of the bent portion 25. In this state, the closed door can be opened by the manipulation of a door handle, because the bent portion 25 of the connecting lever 16 makes the downward movement of the connecting pin 23, whereby the engagement of the pawl 9 of ratchet 10 with the shoulder 6 is released and the latch becomes freely rotatable. On the other hand, when the locking lever 15 is brought to the locking position (FIG. 6), the counter-clockwise rotation of the open lever 13 by the opening operation of door handle can not open the door, because the bent portion 25 of connecting lever 16 comes downward without engaging with the connecting pin 23.

However, in this invention, the mere closing of the door shall not bring the locking thereof, on account of the cancellation lever 20. To wit, when the door is closed, the latch 3 which rotates upon engagement with the striker 5, forces firstly by its large diameter portion C the ratchet 10 to move in the direction V, and then move upwardly so that its pawl 9 comes into engagement with the shoulder 6. By these movements, the connecting pin 23 goes temporarily downwardly with the temporary downward movement of ratchet 10, whereby the cancellation lever 20 is rotated also to the direction V in FIG. 6. The cancellation lever 20 thus moved presses at its abutment 26 the bent portion 26 of connecting lever 16 to the left, resulting in returning the connecting lever 16 and locking lever 15 automatically to the positions if FIG. 4, whereby the bent portion 25 presses the connecting pin downwardly to release the locking. These operations are same to the conventional cancellation mechanisms as illustrated, for example, in FIG. 1.

However, noticeable differences between this invention and conventional ones are to be found as follows. In the conventional ones, since its abutment M of the cancellation lever F makes abutment upon the connecting lever H at the portion T which is a mid point between the axes I and K in FIG. 1, they work heavily. Whereas, in the present invention, since the abutment 26 returns the connecting lever 16 and the locking lever 15 from their positions in FIG. 6 to their positions in FIG. 4 by its engagement with the bent portion 25 which is located further below than the mid point of lever 16 and much closer to the locking lever 15 when compared to FIG. 1, they work very lightly.

In addition to this, the cancellation lever 20 and its associated driving parts, the locations of which are represented by the line Y—Y connecting the pin 22 and the shaft 14 are not within the channel X—X where window glass moves. This means that said window glass channel can be set without being interrupted by said cancellation lever and so on, and can be fitted to a location up to the level of the projection 7. In addition to this advantage, as the connecting lever 16 can be operated smoothly and lightly without a heavy load thereupon, it can be made from plastic materials such as synthetic resins. The connecting lever made of plastic materials prevents its rattling during the running of vehicles, and it also becomes easy to make. This also enables the cancellation lever to be compact.

What is claimed is:

1. An automobile door locking apparatus; which comprises an open lever laterally extending over a base body at its upper middle portion and pivotally mounted to said base body, a locking lever pivotally mounted by a shaft to the lower middle portion of the base body, and a connecting lever pivotally connected at its upper end to one of the ends of the open lever and having at its lower end formed as a slot opening which extends substantially vertically, said locking lever having a portion which extends from a portion thereof adjacent to its shaft toward the slot opening of the connecting lever and having a pin which projects from said portion and engages in the slot opening of the connecting lever;

and a line connecting the shaft of said locking lever and the pivotal connection point between the open lever and the connecting lever lying to one side of a window glass passage which will be mounted in an automobile door together with said door locking apparatus;

said open lever being mounted to said base body at about its middle portion whereby the two operating arms of said open lever are of approximately equal length;

and a separate cancellation lever independently pivotally mounted on the base body at a location to one side of said window glass passage and adjacent to the slot opening of the connecting lever, said cancellation lever being pivotally mounted on an axis spaced from the axis of said locking lever shaft, and said cancellation lever being engageable with said connecting lever at a lower portion thereof.

2. Automobile door locking apparatus as claimed in claim 1, in which the connecting lever is made from a synthetic resin.

3. Automobile door locking apparatus as claimed in claim 1, said base body comprising a main mounting surface and a portion projecting outwardly thereof, and all of said levers together with their pivotal axes and connections being substantially between said main mounting surface and said portion projecting from the base body.

* * * * *